United States Patent [19]

DeAngelis

[11] 4,047,717

[45] Sept. 13, 1977

[54] VOLLEY TENNIS GAME

[75] Inventor: Gloria J. DeAngelis, Elmhurst, N.Y.

[73] Assignee: The Raymond Lee Organization, Inc., New York, N.Y. ; a part interest

[21] Appl. No.: 605,545

[22] Filed: Aug. 18, 1975

[51] Int. Cl.[2] ..... A63B 71/02; A63B 59/00; A63B 63/00

[52] U.S. Cl. ..... 273/95 H; 273/67 R; 273/96 R; 273/97 R; 273/102 R; 273/85 F; 272/1 B

[58] Field of Search ..... 273/67 R, 67 A, 73 L, 273/95 R, 95 H, 105 R, 67 B, 73 R, 96 R, 97 R, 102 R, 85 F; 272/1 B

[56] References Cited

U.S. PATENT DOCUMENTS

| | | | |
|---|---|---|---|
| 1,419,554 | 6/1922 | Ganse | 273/95 H |
| 1,433,437 | 10/1922 | Wakeham | 273/95 H |
| 3,239,224 | 3/1966 | Finn | 273/67 B |
| 3,467,381 | 9/1969 | Kreiss | 273/96 R |
| 3,507,494 | 8/1967 | Finkel | 273/67 R |
| 3,711,092 | 1/1973 | Hogue | 273/67 R |
| 3,802,703 | 4/1974 | Tassel | 273/95 H |
| 3,891,211 | 6/1975 | Diefenbach | 273/73 L |
| 3,923,304 | 12/1975 | Warren | 273/95 H |

FOREIGN PATENT DOCUMENTS

| | | | |
|---|---|---|---|
| 282,936 | 2/1966 | Australia | 273/67 B |

*Primary Examiner*—Richard C. Pinkham
*Assistant Examiner*—Vance Y. Hum
*Attorney, Agent, or Firm*—Daniel Jay Tick

[57] ABSTRACT

Each of a pair of portable basket members is held by a corresponding player of a corresponding one of two teams. A plurality of ball striking members are held by the remaining players of the teams. Each ball striking member comprises a frame having a net of cord-like members supported therein in matrix configuration. The ball striking members are used to strike a ball of substantially volley ball size in attempting to hit the ball into the basket member of the other team.

12 Claims, 28 Drawing Figures

A
F
D
37
E
C
B 14
10
12
8
13
15

18
16
10
8
19
17

4
2
5
3

50
54
51
52
53

38
39
38
37

33
28
29
30
31
25
34
32
26
27
24

75
65
76
69
68
72
74
73

22
9
64
61
63

62
23
11

55

60
59
56
20
11
9
1
21

55
58
57
46
42
43
41
47
44
48
49
45
35
28
29
30
31
25
36
32
26
27
24

VOLLEY TENNIS GAME

DESCRIPTION OF THE INVENTION

The present invention relates to a volley tennis game.

Objects of the invention are to provide a volley tennis game which is interesting, recreational, entertaining, good exercise, and exciting.

In order that the invention may be readily carried into effect, it will now be described with reference to the accompanying drawing, wherein.

The volley tennis game of the invention is for a plurality of players in two teams. The three players of one team are required to stand in their allotted spaces A, B and C of the court shown in FIG. 1. The three players of the other team are required to stand in their allotted spaces D, E and F of the court of FIG. 1.

The game is played with a ball 1 (FIG. 7) of substantially volley ball size.

Each of a pair of portable basket members is held by a corresponding player of a corresponding one of the teams. Thus, the player standing in the area C holds the basket for one team and the player standing in the area F holds the basket for the other team. Each of the basket members comprises a substantially circular frame 2 (FIGS. 4 and 5) and a net 3 of cord-like members supported thereby and hanging therefrom (FIGS. 4 and 5).

Figures 1, 2, 3, 4, 6, 7, 8, 9, 11, 12, 13, 14, 15, 16:
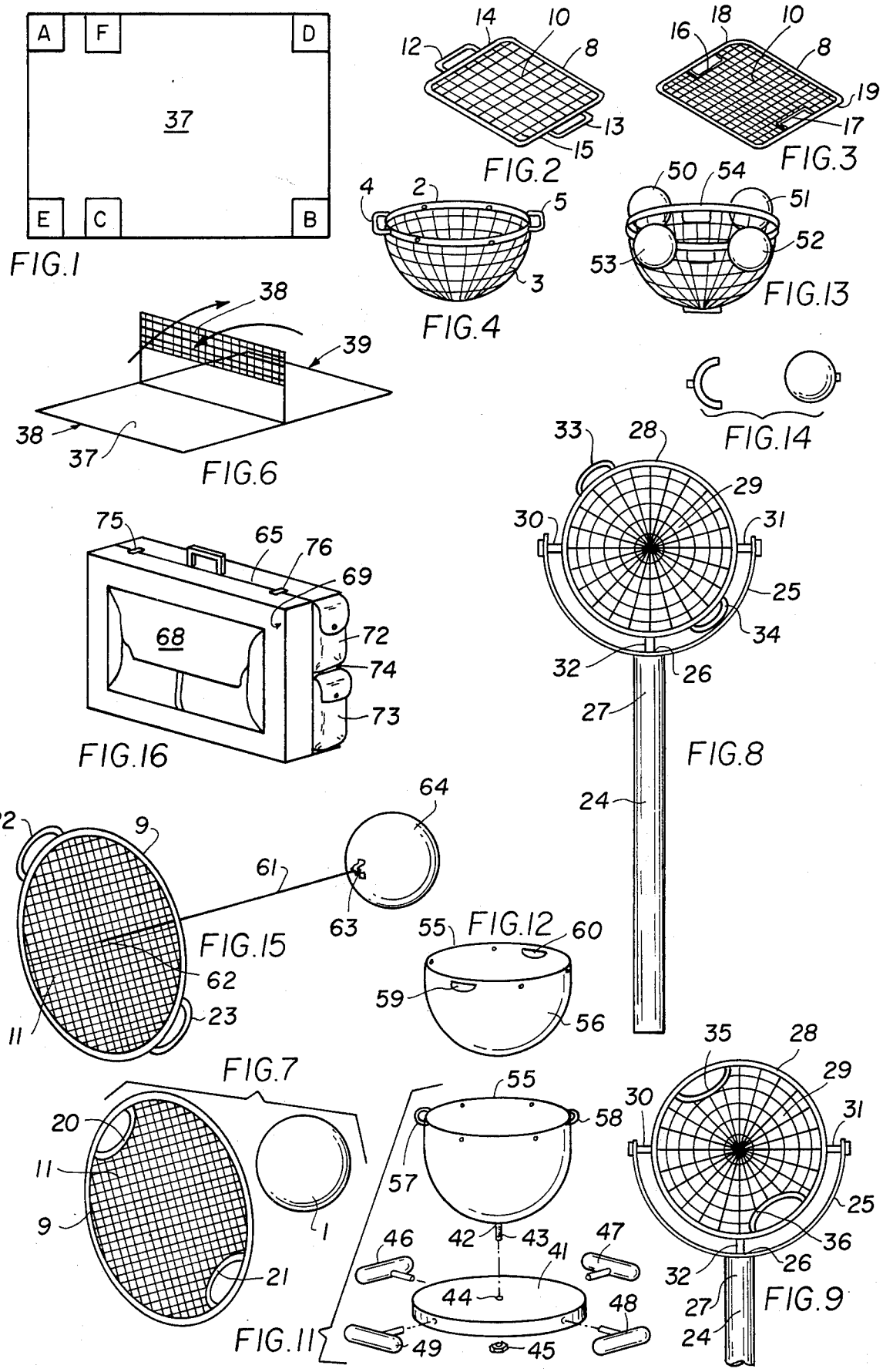
FIG. 1 is a schematic diagram of an embodiment of the court of the volley tennis game of the invention.
FIG. 2 is a view of an embodiment of a ball striking member of the volley tennis game of the invention with handles extending outward.
FIG. 3 is a view of another embodiment of a ball striking member of the volley tennis game of the invention with handles extending inward.
FIG. 4 is a perspective view of an embodiment of a basket member of the volley tennis game of the invention with handles extending outward.
FIG. 6 is a view of another embodiment of the court of the volley tennis game of the invention.
FIG. 7 is a view of another embodiment of the basket member of the volley tennis game of the invention of round type with handles extending inward.
FIG. 8 is a view of another embodiment of a ball striking member of the volley tennis game of the invention of round type with handles extending outward and connected to a bat handle.
FIG. 9 is a view of still another embodiment of a ball striking member of the volley tennis game of the invention of round type with handles extending inward and connected to a bat handle.
FIG. 11 is a perspective exploded view of an embodiment of a floating basket of the water volley tennis game of the invention.
FIG. 12 is a perspective view of another embodiment of a floating basket of the water volley tennis game of the invention affixable to float member of FIG. 11.
FIG. 13 is a perspective view of still another embodiment of a floating basket of the water volley tennis game of the invention.
FIG. 14 is a view, on an enlarged scale, of a float and an affixing member of the embodiment of FIG. 13.
FIG. 15 is a perspective view of an embodiment of the ball game of the invention.
FIG. 16 is a perspective view of an embodiment of the carrying case of the invention for sports equipment.
Figure 5:
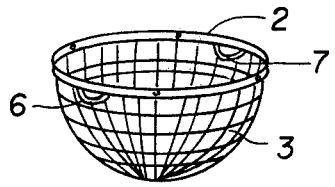
FIG. 5 is a perspective view of another embodiment of a basket member of the volley tennis game of the invention with handles extending inward.
Figure 10:
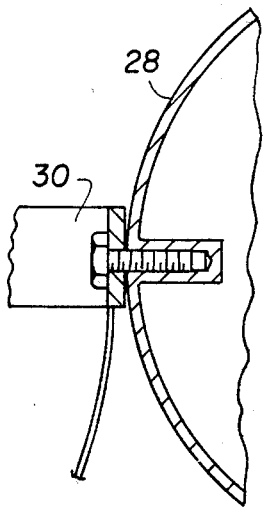
FIG. 10 is a cross-sectional view, on an enlarged scale, of part of the ball striking member of FIG. 8.

The basket member of the embodiments of FIGS. 4 and 5 has a pair of handles on diametrically opposite sides of the frame 2. In the embodiment of FIG. 4, the handles 4 and 5 extend away from each other, toward the outside. In the embodiment of FIG. 5, the handles 6 and 7 extend downward. The frame is the handle. If desired, the handles on the frame 2 may extend toward each other or upward.

A plurality of ball striking members is provided. The ball striking members are held by the remaining players of the teams. Each ball striking member comprises a frame 8 (FIGS. 2 and 3) or 9 (FIGS. 7 and 15) having a net 10 (FIGS. 2 and 3) or 11 (FIGS. 7 and 15) of cord-like members supported therein in matrix configuration. The frame 8 is of rectangular configuration of unitary structure or of separate parts joined at the four corners. The handles of the frame 8 are inward or outward, as shown, and as hereinafter described. The frame may also be of round or oblong shape. The ball striking members are utilized to strike the ball in attempting to hit the ball into the basket member of the other team. The ball striking members may be shaped in any desired variations, round or rectangular, with outward or inward extending handles, on some or all of the sides. They may vary as desired in size according to who is using them, and in shape.

Each of the ball striking members has a pair of handles on opposite sides of the frame 8 or 9. The frame 8 of the embodiments of FIGS. 2 and 3 is substantially rectangular having rounded corners. The handles 12 and 13 of the embodiment of FIG. 2 are provided on opposite sides 14 and 15, respectively, of the frame 8 and extend away from each other. The handles 16 and 17 of the embodiment of FIG. 3 are provided on opposite sides 18 and 19, respectively, of the frame 8 and extend toward each other.

In the embodiments of FIGS. 7 and 15, the frame 9 is substantially circular. The handles 20 and 21 of the embodiment of FIG. 7 are provided on diametrically opposite sides of the frame 9 and extend toward each other. In the embodiment of FIG. 15, the handles 22 and 23 are provided on diametrically opposite sides of the frame 9 and extend away from each other. The frames and handles may be of different sizes, shapes and materials, as desired.

The ball striking members of the embodiments of FIGS. 8 and 9, each comprise a rod-like handle member 24. A substantially semicircular support member 25 is affixed at its center 26 to one end 27 of the handle (FIGS. 8 and 9). A frame 28 of substantially circular configuration has a net 29 of cord-like members supported therein in diametrically extending arrangement. Mounting pins 30, 31, and 32 mount the frame 28 is the support member 25 (FIGS. 8 and 9). The bat-type handle is connected, as described, to the ball striking member (FIGS. 8 and 9) and may be varied is size and shape to fit differennt types and sizes of ball striking members. They may also be used as a basket, ball catching, device.

In the embodiment of FIG. 8, a pair of handles 33 and 34 extend from diametrically opposite sides of the frame 28 away from each other. In the embodiment of FIG. 9, a pair of handles 35 and 36 extend from diametrically opposite sides of the frame 28 toward each other.

As shown in FIG. 1, the volley tennis game of the invention is played on a court 37 of substantially rectangular configuration for positioning the players. The court 37 has four squares A, B, D, and E, each in a corresponding corner of the rectangle. Each of the squares A, B, D and E positions a player and restricts the player's position to the confines of the square. An additional two squares C and F are provided at opposite sides of the rectangular court 37 and intermediate the corners E and B, and A and D, respectively, of the corresponding sides. Each of the squares C and F positions a basket member holding player, as hereinbefore described, and each restricts the player's position to the confines of the square. As hereinbefore described, the players in the squares A, B and C are on one team and the players in the squares D, E and F are on the other team.

As shown in FIG. 6, a net 38 may be provided across the court 37 extending halfway between the short sides 38 and 39 of the court and parallel thereto.

The water volley tennis game of the invention comprises the same number of players in the same number of teams as the volley tennis game of the invention and is played in the same manner, except that the water volley tennis game is played in water and the volley tennis game is played on land. Thus, the water volley tennis game of the invention comprises a ball 1 (FIG. 7) of substantially volley ball size.

Each of a pair of floating baskets floats in the area of a corresponding one of the teams. The basket 40 of the embodiment of FIG. 11 has a flat cylindrical float member 41 affixed to the bottom 42 of the basket by any suitable means such as, for example, an externally threaded member 43 extending from the bottom 42 of the basket 40, passing through an aperture 44 through the center of the float member 41 and a nut 45 (FIG. 11). A plurality of equiangularly spaced handles 46, 47, 48 and 49 may be provided on the float member 41 in radially extending positions, as shown in FIG. 11.

The basket of the embodiment of FIG. 13 has a plurality of floats 50, 51, 52 and 53 affixed to its substantially circular frame 54 in spaced equiangular relation. The basket of the embodiments of FIGS. 11, 12 and 13 each have a substantially circular frame 54 (FIG. 13) and 55 (FIGS. 11 and 12). Each of the baskets 40 (FIG. 11) and 56 (FIG. 12) has a pair of handles on diametrically opposite sides of the frame 55. In the embodiment of FIG. 11, the handles 57 and 58 extend away from each other. In the embodiment of FIG. 12, the handles 59 and 60 are formed in the basket and extend downward. The handles may, of course, extend toward each other or upward. The handles may be of different sizes, shapes and materials, such as, for example, plastic.

The ball game of the invention, as shown in FIG. 15, comprises a ball striking member having a substantially circular frame 9 and a pair of handles 22 and 23 on diametrically opposite sides thereof, facing outward, as hereinbefore described. The ball striking member further comprises the net 11 of cord-like members supported in the frame 9 in matrix configuration, as hereinbefore described (FIG. 15).

As shown in FIG. 15, an elastic cord-like member 61 has one end 62 affixed to the net 11 at substantially the center thereof and another end 63 affixed to a ball 64 of substantially volley ball size. Thus, the ball 64 is strikeable with the ball striking member and is returned, after being struck, to the ball striking member by the cord-like member 61.

Figure 18:
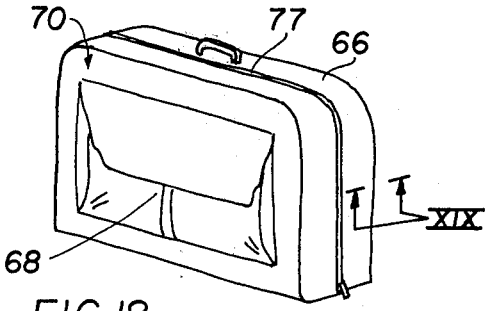
FIG. 18 is a perspective view of another embodiment of the carrying case of the invention for sports equipment.
Figure 19:
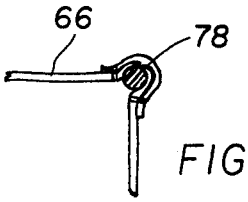
FIG. 19 is a cross-sectional view, on an enlarged scale, taken along the lines XIX—XIX, of FIG. 18.
Figure 20:
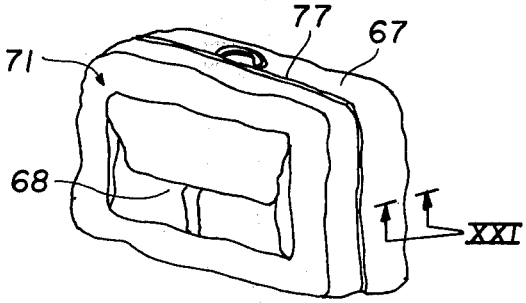
FIG. 20 is a perspective view of still another embodiment of the carrying case of the invention for sports equipment.
Figure 21:
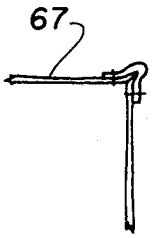
FIG. 21 is a cross-sectional view, on an enlarged scale, taken along the lines XXI—XXI, of FIG. 20.

The carrying case of the invention is for carrying sports equipment, and more specifically for carrying the equipment of the volley tennis and water volley tennis games of the invention. The carrying case 65 (FIGS. 16 and 17), 66 (FIGS. 18 and 19), or 67 (FIGS. 20 and 21) comprises an outside pocket 68 affixed to a surface 69 (FIG. 16), 70 (FIG. 18) or 71 (FIG. 20), respectively, of the case for storing additional items. The case 65 of FIGS. 16 and 17 has an additional pair of outside pockets 72 and 73 on a surface 74 thereof. The case may be of any suitable material, size or shape to accommodate the equipment.

Figure 17:
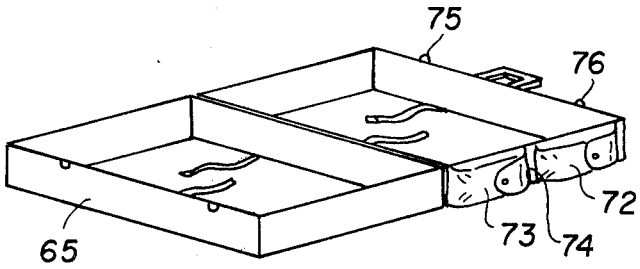
FIG. 17 is a perspective view of the embodiment of FIG. 16 wide open.

A pair of spaced clamps 75 and 76 selectively opens and closes the carrying case 65 of the embodiment of FIGS. 16 and 17. A zipper 77 selectively opens and closes the carrying cases 66 and 67 of FIGS. 18 and 20. The carrying case 18 has a stiffening frame 78 (FIG. 19) in the case for shaping said case. The frame is eliminated in the case 67 of FIG. 20.

The miniature volley tennis game of the invention comprises a housing having a base member 79 (FIGS. 22 to 28) and a dome 80 (FIGS. 22, 23, 25, 26 and 28) of transparent material of any suitable type such as, for example, clear plastic, covering the base member. A miniature ball 81 (FIGS. 22, 23, 25, 26 and 28) hangs from the center of the dome 80 on a string 82 in the housing. The ball may be pulled up to swing from the dome to start the game action.

Figure 22:
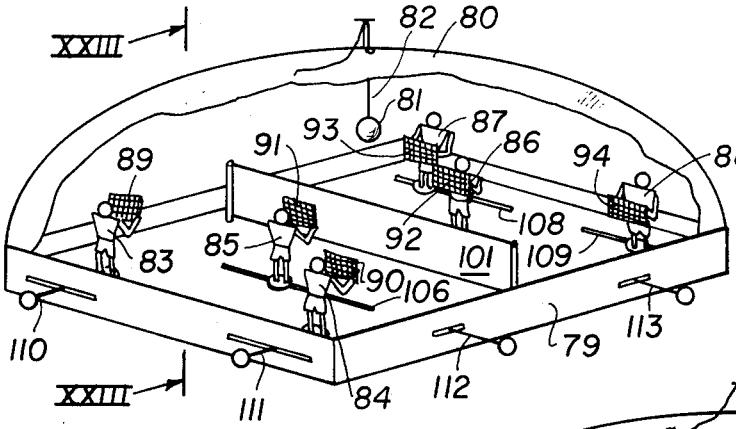
FIG. 22 is a partially cutaway perspective view of an embodiment of the miniature volley tennis game of the invention.
Figure 25:
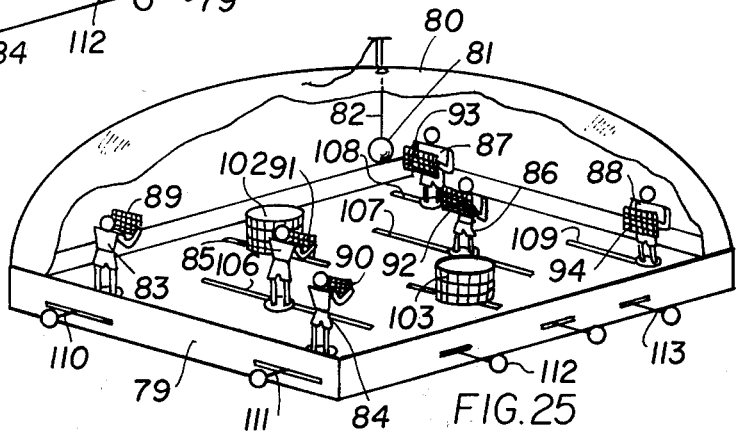
FIG. 25 is a partially cutaway perspective view of another embodiment of the miniature volley tennis game of the invention.
Figure 26:
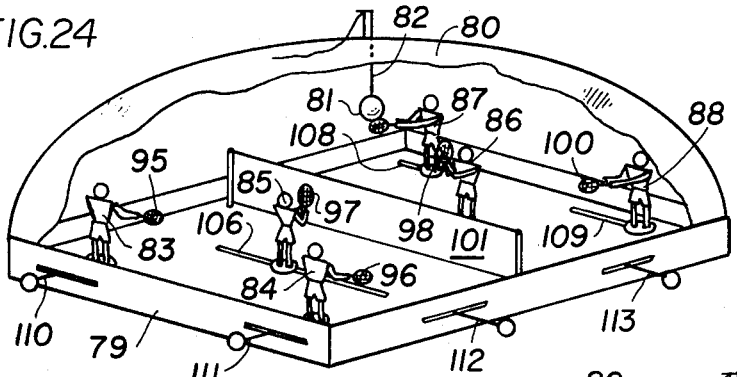
FIG. 26 is a partially cutaway perspective view of still another embodiment of the miniature volley tennis game of the invention.
Figure 27:
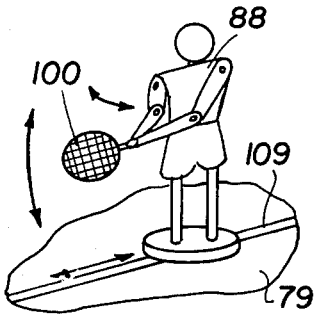
FIG. 27 is a view, on an enlarged scale, of a figure of the embodiment of FIG. 26, illustrating the movement thereof.

A plurality of miniature FIGS. 83, 84, 85, 86, 87 and 88 are movably mounted on the base member 79 in the housing as shown in FIGS. 22, 25, 26 and 28. Each of the FIGS. 83 to 88 has movable arms and holds a ball striking member 89 to 94, respectively (FIGS. 22 and 25) and 95 to 100 (FIGS. 26 and 28) at the free ends of its arms. In the embodiments of FIGS. 22 and 25, each ball striking member comprises a frame having a net of cord-like members supported therein in matrix configuration, in the manner of the aforedescribed ball striking members. In the embodiments of FIGS. 26 and 27, each ball striking member comprises a frame having a net of cord-like members supported therein in matrix configuration in the embodiment of a miniature tennis racket of known type and held by each figure of both hands, in the manner of a bat (FIG. 27), or a racket. The ball striking members may be of different shapes, sizes or configurations.

In the embodiments of FIGS. 22 and 26, a net 101 extends across the base member 79 along the center thereof. The FIGS. 83 to 88 are positioned in two teams, each on a corresponding side of the net.

Figure 28:
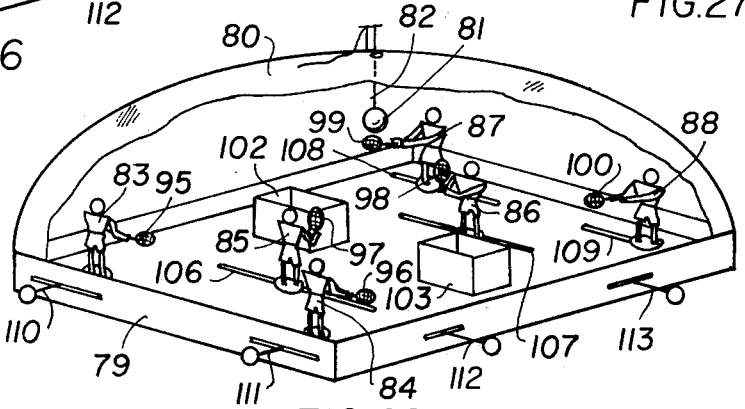
FIG. 28 is a partially cutaway perspective view of yet another embodiment of the miniature volley tennis game of the invention.
Figure 23:
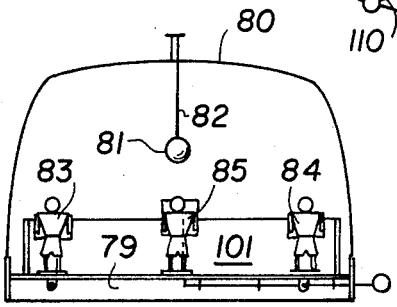
FIG. 23 is a view, taken along the lines XXIII—XXIII, of FIG. 22.

In the embodiments of FIGS. 25 and 28, a pair of spaced ball receptacle 102 and 103 are positioned on the base member 79 along the center thereof. The FIGS. 83 to 88 are positioned in two teams each on a corresponding side of the receptacles 102 and 103. A single center basket type receptacle may be provided, which may be stationary or movable and of any desired size or shape.

A control device extends outside the housing for moving the FIGS. 83 to 88 in position and for moving the arms of the figures to strike the ball to predetermined areas of the base member. Thus, in the embodiments of FIGS. 22 and 26, the control device is used to move the arms of the figures to strike the ball over the net 101 and in the embodiments FIGS. 25 and 28, it is used to move the arms of the figures to strike the ball into the receptacles 101 and 103. The control device comprises a plurality of slots 104 and 105 (not shown in the FIGS.), 106, 107, 108 and 109 (FIGS. 22, 25, 26 and 28) formed through the base member 79. Each of the figures 83 to 88 is positioned over a corresponding one of the slots 104 to 109, respectively.

The control device further comprises a plurality of control rods 110, 111, 112, 113 (FIGS. 22, 25, 26 and 28) and 114 and 115 (not shown in the FIGS.) each extending from a corresponding one of the FIGS. 83 to 88, respectively, through the corresponding slot 104 to 109, respectively, to areas outside the housing for permitting manual movement of the figures.

Figure 24:
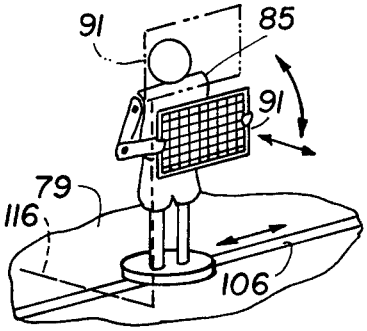
FIG. 24 is a view, on an enlarged scale, of a figure of the embodiment of FIG. 22, illustrating the movement thereof.

A plurality of control cables, of which a signle control cable 116 is shown in FIG. 24, are provided. Each of the control cables extends from the arms of a corresponding one of the figures through the corresponding slot for permitting manual movement of the arms of the figure to move the striking member held by the figure. Thus, people playing the miniature volley tennis game control the positions of their associated figures by suitable movement, in and out of the base member 79, of the control rods 110 to 115 and control the movement of the arms of the associated figures by suitable movement of the corresponding control cables.

Every item, object, member, piece of equipment, or the like, described herein, such as, for example, every ball, figure, basket member, handle, ball striking member, frame, rod-like handle member, float member, basket, net, cord-like member, carrying case, clamps, pockets, dome, ball receptacle, or the like, may be of any suitable, size, shape, material or configuration.

While the invention has been described by means of specific examples and in specific embodiments, I do not wish to be limited thereto, for obvious modifications will occur to those skilled in the art without departing from the spirit and scope of the invention.

I claim:

1. A volley tennis game, for a plurality of players in two teams, comprising a ball of substantially volley ball size;

a pair of portable basket members each held by a corresponding player of a corresponding one of the teams;

a plurality of ball striking members held by the remaining players of the teams, each ball striking member comprising a frame having a net of cord-like members supported therein in matrix configuration, said ball striking members being utilized to strike the ball in attempting to hit the ball into the basket member of the other team; and a court for positioning the players, said court being substantially rectangular and having four squares each in a corresponding corner of the rectangle and each positioning a player and restricting the player's position to the confines of the square and an additional two squares at opposite sides of the rectangular court and intermediate the corners of the corresponding sides each positioning a basket member holding player and each restricting the player's position to the confines of the square.

2. A volley tennis game as claimed in claim 1, wherein each of the basket members comprises a substantially circular frame, a net of cord-like members supported thereby and hanging therefrom, and a pair of generally U-shaped handles on diametrically opposite sides of the frame.

3. A volley tennis game as claimed in claim 2, wherein the handles extend inwardly toward each other.

4. A volley tennis game as claimed in claim 2, wherein the handles extend outwardly away from each other.

5. A volley tennis game as claimed in claim 1, wherein each of the ball striking members has a pair of generally U-shaped handles on opposite sides of the frame.

6. A volley tennis game as claimed in claim 1, wherein each ball striking member comprises a substantially rectangular frame having rounded corners and a pair of generally U-shaped handles on opposite sides of the frame and extending inwardly toward each other.

7. A volley tennis game as claimed in claim 1, wherein each ball striking member comprises a substantially circular frame and a pair of generally U-shaped handles on opposite sides of the frame and extending outwardly away from each other.

8. A volley tennis game as claimed in claim 1, wherein each ball striking member comprises a rod-like bat type handle member, a substantially semicircular support member affixed at its center to one end of the handle, a frame of substantially circular configuration having a net of cord-like members supported therein in diametrically extending arrangement, and mounting means mounting said frame in said support member.

9. A volley tennis game as claimed in claim 5, wherein the frame of the basket member has a pair of handles on diametrically opposite sides of the frame, said handles being of generally U-shape and extending inwardly toward each other.

10. A volley tennis game as claimed in claim 8, wherein the handles extend outwardly away from each other.

11. A volley tennis game as claimed in claim 1, further comprising a pair of basket supporting members for supporting the basket members in upright positions on the court.

12. A volley tennis game as claimed in claim 11, wherein each of the basket supporting members comprises a substantially semispherical member and a base plate supporting said semispherical member in substantially upright position.

* * * * *